United States Patent [19]

Fisher et al.

[11] Patent Number: 4,599,675

[45] Date of Patent: Jul. 8, 1986

[54] SELF MONITORING SOLID STATE SWITCHING SYSTEM

[75] Inventors: Kenneth W. J. Fisher; Michael J. Hare, both of Bristol, England

[73] Assignee: P. J. Hare Limited, Avon, England

[21] Appl. No.: 629,707

[22] Filed: Jul. 11, 1984

[51] Int. Cl.[4] ..... H01H 47/24

[52] U.S. Cl. ..... 361/173; 361/190

[58] Field of Search ..... 361/173, 177, 189, 190

[56] References Cited

U.S. PATENT DOCUMENTS 3,662,227 5/1972 Morrison et al. ..... 361/189

4,291,359 9/1981 Dieterle ..... 361/173

*Primary Examiner*—L. T. Hix

*Assistant Examiner*—David M. Gray

*Attorney, Agent, or Firm*—Toren, McGeady, Stanger, Goldberg & Kiel

[57] ABSTRACT

A solid state switching system for use with solenoid operated control valves, especially control valves for dangerous machinery including a light screen guard fitted for personnel protection. The switching system comprises two transistors in series with the solenoid coil. A self-checking monitoring system for monitoring the state of the two switches is provided. The monitoring system has a plurality of switching elements arranged in such a way that no single electrical fault can result in an inadvertent energization of the control valve. Specifically in the event that one of the switches is off while the other is still conducting, the monitoring system inhibits switching on of the switch that is off. The monitor system verifies that no fault has occurred during any one cycle of operation which might not otherwise be apparent. Every component in the switching and monitoring circuits functions during each on/-off cycle. A logic interface is provided and only permits a subsequent cycle to commence when every monitor output from each switching system is satisfactory.

13 Claims, 2 Drawing Figures

SELF MONITORING SOLID STATE SWITCHING SYSTEM

DESCRIPTION

Figure 1:
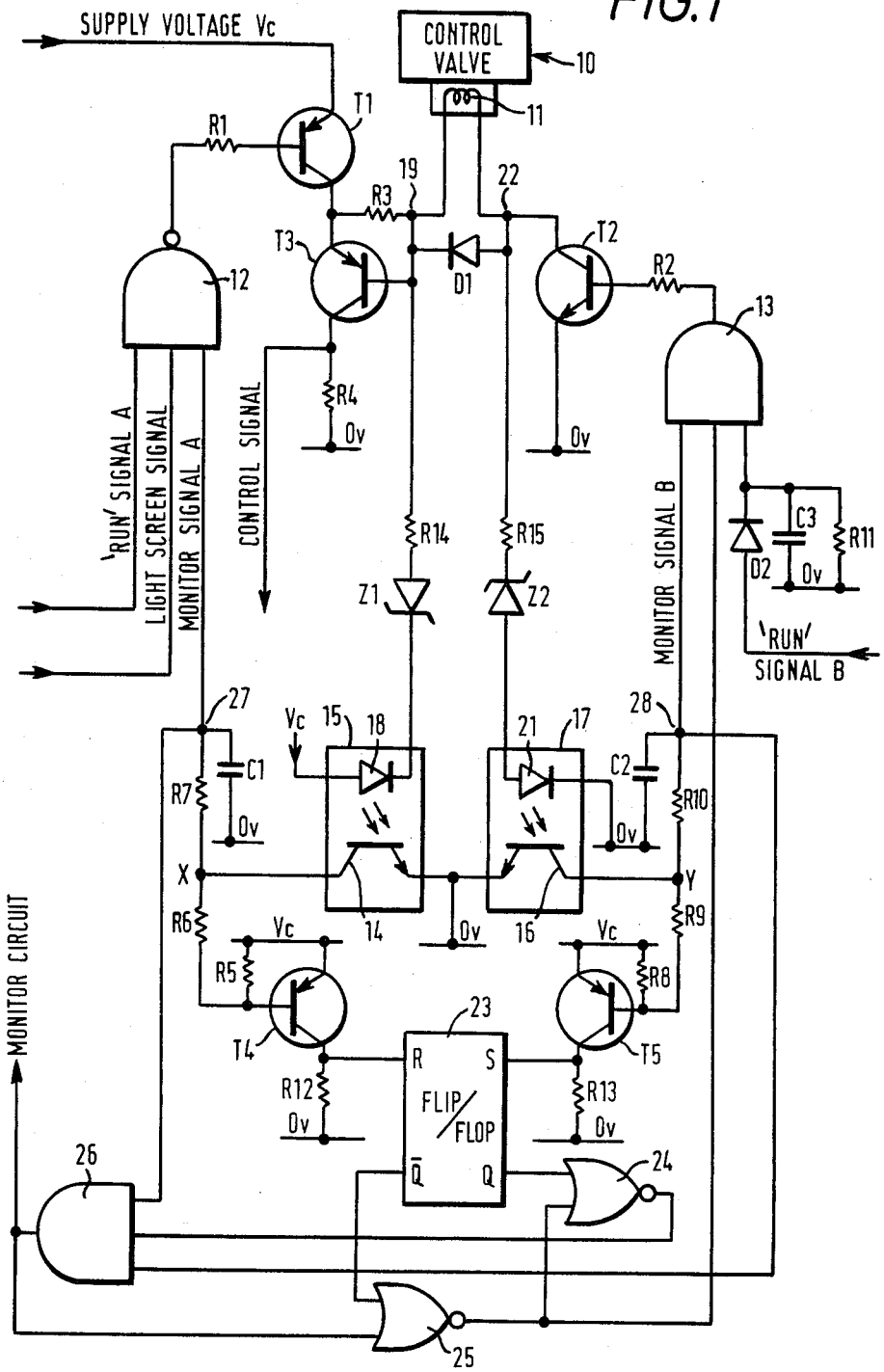

This invention relates to a switching system intended for use in conjunction with solenoid operated valves in which the integrity of every component within the switching system is subjected to surveyance by a monitoring system each time the switching system is activated and de-activated. In addition the monitoring system is self-checking, verifying the integrity of the monitored signal.

It is usually mandatory that, where solenoid valves are used to control the motions of dangerous machinery, such as presses, press brakes, guillotines, no single failure of any component in the control system can result in an inadvertent operation of the machine. Hence for machines controlled by solenoid operated valves, it is necessary to provide at least two switching elements in series in such a way that all the elements must change state to energise the solenoid. It is equally important to ensure that at least two switching elements are non-conducting when the valve is de-energised to be sure that a single failure cannot re-energise the valve inadvertently. Systems of this type are particularly useful as an interface where electro-sensitive guards such as "light screen guards" are, employed in place of the more conventional interlocked mechanical guards. Interruption of the light screen by the operator during the dangerous part of a cycle of operation must de-energise the control valves and either stop or reverse the motion in the minimum time possible.

TECHNICAL BACKGROUND

The existing state of the art employs electro-mechanical relay systems in which the relay contacts are mechanically linked in such a way that welded contacts which fail to open automatically prevent operation of other essential elements necessary for continuing operation of the machine thus effectively stopping the machine from performing further operations. UK-A-1590904 discloses such a system.

BRIEF DESCRIPTION OF THE INVENTION

The invention is embodied in a solid state electronic switching system for solenoid operated valves which will not allow the valves it controls to adopt a dangerous condition in the event of a spurius signal arriving as a result of a single electrical failure whenever occurring, together with a self-checking monitoring system which verifies that no single fault has developed and is lying dormant during each on/off cycle of operation and a logic interface which checks that a single or plurality of monitor outputs are satisfactory before allowing a new cycle of operation to commence. The switching system includes two switches in series with the solenoid coil which is beween them. One of the functions of the monitoring system is to check the state of the two switches. In the event that one of the switches is off while the other is still conducting, the monitoring system operates to inhibit switching of the switch that is off to its conducting state. The system is used as an interface to control dangerous machinery fitted with electro-sensitive guarding, such as a light screen guard incorporating, if applicable, its own intrinsic monitoring system, so as to stop or reverse the dangerous motion of the machine in the event of the light screen being interrupted by the machine operator, any other person, or foreign body. The system will not allow the dangerous motion to recommence when the guard area is subsequently cleared after an inadvertent interruption of the light screen, however occurring, until a positive action is taken by the operator, such as pressing a restart button. The preferred embodiment of the system employs opto-isolator devices in the monitoring system to verify that the solid state switching system is operating correctly and that no dormant fault has developed which may lead to an inadvertent operation occurring subsequently.

Replacement of electro-mechanical relays as used in the prior art with solid state switching devices has the following advantages:

1. Faster interruption of the energising current to the solenoid operated control valves resulting in less overrun of the dangerous motion.
2. Higher integrity and virtually infinite life whereas electro-mechanical relays have a limited number of operating cycles.
3. Reduced and easier maintenance.

Figure 2:
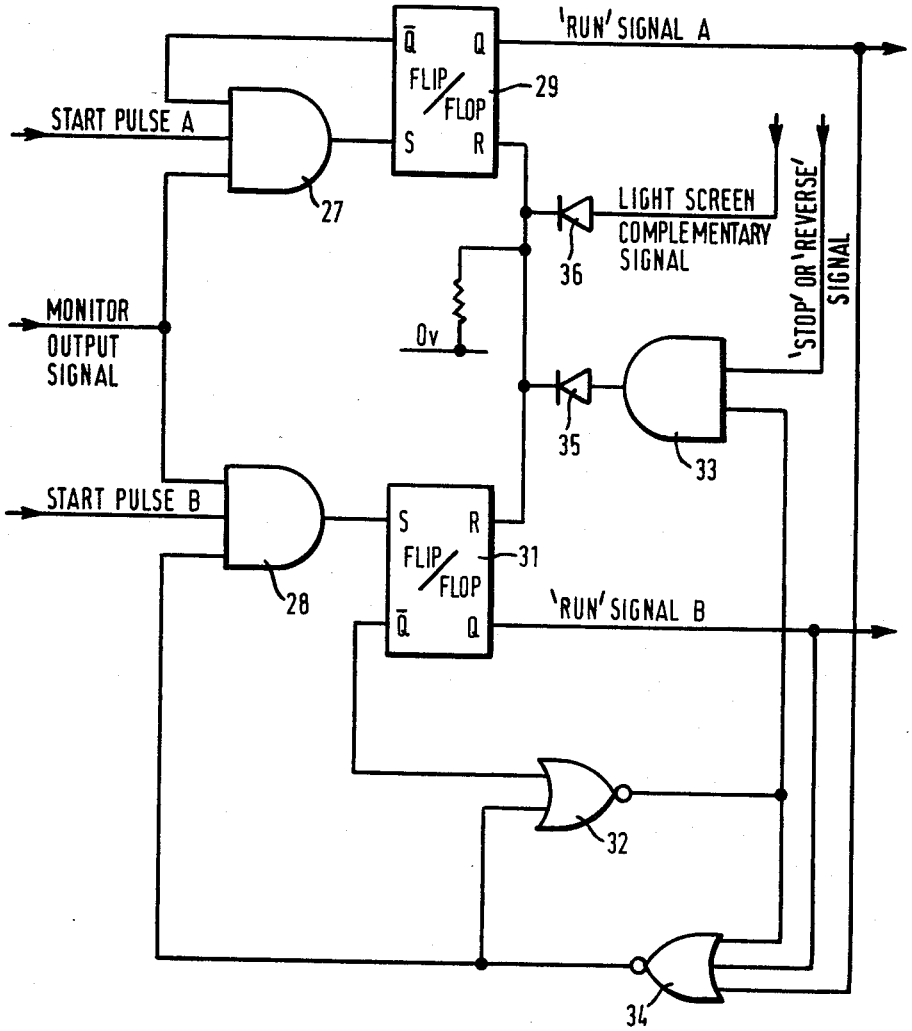

A preferred embodiment of this invention is described now by way of example with reference to the accompanying drawings, of which:

FIG. 1 is a circuit diagram of an electronic switch circuit for a solenoid operated control valve of a machine, such as a press, fitted with a light screen guard, the switch circuit being associated with a self-checking monitoring system; and FIG. 2 is a circuit diagram of an electronic stop/start control circuit of the machine, the stop/start control circuit being connected with the switch circuit and self-checking monitoring system illustrated diagrammatically in FIG. 1.

FIG. 1 shows a solenoid operated control valve 10 having a solenoid coil 11. One end of the coil 11 is connected to a supply voltage $V_c$ by a current sensing resistor R3 and a PNP transistor T1 in series. The other end of the coil is connected to earth (0V) by an NPN transistor T2. A NAND gate 12 has three inputs and an output, the output being connected to the base of the transistor T1 via a resistor R1. An AND gate 13 has three inputs and an output, the output being connected to the base of the transistor T2 via a resistor R2.

Another PNP transistor T3 has its base connected to a junction 19 between the coil 11 and the resistor R3 and its emitter connected to the collector of the transistor T1 so that the resistor R3 is connected across its base and its emitter. The collector of the transistor T3 is connected to earth through a resistor R4.

Providing that all three inputs to the NAND gate 12 are 'HI', the output is 'LO' and the resistor R1 is chosen so that the base current through the transistor T1 is sufficient to drive it into saturation. The collector voltage will then rise to approximately 160 mv below the supply voltage $V_c$. Similarly if the three inputs to the AND gate 13 are HI, the output is HI and the resistor R2 drives sufficient base current through the transistor T2 to cause saturation and the collector voltage falls to within 160 mv of 0 volts. A potential difference is thereby created across the solenoid coil 11 and a current will flow which is limited by the internal resistance of the coil 11.

The current energising the control valve coil 11 passes through the current sensing resistor R3 which is chosen to give a voltage drop of approximately 680 mv which is sufficient to make the transistor T3 conduct and give a "control signal" which, although not referred to again in this description, can be used for any purpose such as in conjunction with other control signals where appropriate to initiate the next part of the cycle of operation of the machine. The resistor R4 functions as a pull down resistor to cancel this control signal when the solenoid winding 11 of the control valve 10 is de-energised.

A diode D1 allows magnetic flux in the solenoid winding 11 to dissipate rapidly.

It follows that the voltage drop across the coil 11 when the transistors T1 and T2 are conducting is approximately 1 volt less than $V_c$. The supply voltage $V_c$ can be chosen to give the design voltage across the solenoid coil 11.

It is necessary for all six signals to the NAND gate 12 and to the AND gate 13 to be HI for the control valve solenoid coil 11 to be energised. Disappearance of any one of these six signals will interrupt the energising current through the coil 11.

The three signals to the inputs of the NAND gate 12 comprise a run signal A, a light screen signal and a monitor signal A. The three signals to the three inputs of the AND gate 13 comprise a run signal B, a monitor signal B and a self-check verifying signal. The two run signals A and B are produced by the stop/start control circuit which is described below with reference to FIG. 2. The light screen signal is only HI when the guard area is clear. Interruption of the light screen will cause this signal to go LO and the control valve will be switched off.

It will be noted that two signals, viz. the run signals A and B, are necessary to effect energisation of the solenoid coil 11 of the control valve 10 so that no single signal can energise that coil 11. However it is essential that both transistors T1 and T2 cease to conduct when the solenoid winding 11 is de-energised for that requirement to be met. A function of the self-checking monitoring system associated with the switch circuit is to verify that both the transistors T1 and T2 are switched off before the solenoid winding 11 of the control valve 10 can be re-energised.

The monitor signal A fed to an input of the NAND gate 12 is produced by three resistors R5, R6 and R7 which are connected in series between the supply voltage $V_c$ and the respective input of the NAND gate 12. The monitor signal B which is fed to an input of the AND gate 13 is produced by three resistors R8, R9 and R10 which are connected in series between the supply voltage $V_c$ and the respective input of the AND gate 13.

A junction X between the resistors R6 and R7 is connected to earth through the transistor section 14 of an opto-isolator 15. A junction Y between the resistors R9 and R10 is connected to earth through the transistor section 16 of an opto-isolator 17.

The supply voltage $V_c$ is connected to the anode of the light emitting diode section 18 of the opto-isolator A. The cathode of the light emitting diode section 18 is connected through a zener diode Z1 and a current limiting resistor R14 to the supply side of the solenoid coil 11 at the junction 19 between the resistor R3 and the solenoid coil 11. The return side of the solenoid coil 11 is connected to earth through a current limiting resistor R15, a zener diode Z2 and the diode section 21 of the opto-isolator 17 in series, the zener diode Z2 being connected between a junction 22 in the switch circuit between the solenoid coil 11 and the collector of the transistor T2 and the anode of the light emitting diode section 21, the cathode of the light emitting diode section 21 being connected to earth. Thus the two light emitting diode sections 18 and 21, the two zener diodes Z1 and Z2, their current limiting resistors R14 and R15 and the solenoid coil 11 form a chain in series between the supply voltage $V_c$ and earth. The breakthrough voltages of the zener diodes Z1 and Z2 are chosen so that individually they are lower than the supply voltage $V_c$ but together in series they are in excess of the supply voltage $V_c$. Hence with both transistors T1 and T2 switched off, no current will flow through either opto-isolator 15, 17 and the monitor signals A and B will both be HI.

The resistors R14 and R15 limit the current flowing through the solenoid coil 11 to a value far below that required to energise the solenoid coil 11 but sufficient to activate the respective opto-isolators 15 and 17. There is substantially no voltage drop across each of the parallel circuit paths through the respective diode section 18, 21 and the series connected zener diode Z1, Z2 and resistor R14, R15 to the respective junction 19, 22 in the switch circuit when both transistors T1 and T2 are in their conducting states, due to the internal resistance of the solenoid coil 11. Hence no current flows through either parallel circuit path in that condition.

The transistor section 14 of the opto-isolator 15 will pull the voltage at junction X down to approximately 0 volts whenever the light emitting diode section 18 of that opto-isolator 15 is alight. However a time constant $t_1$ produced by the resistor R7 and a capacitor C1 delays the disappearance of the HI monitor signal A at the respective input of the NAND gate 12. The opto-isolator 17, the resistor R10 and the capacitor C2 perform substantially the same function with reference to the monitor signal B at the respective input to the AND gate 13.

The run signal B is supplied to the respective input of the AND gate 13 via a diode D2, the cathode of the diode D2 being connected to the input of the AND gate 13. A junction between the cathode of the diode D2 and the respective input of the AND gate 13 is connected in parallel to an earth connection through a resistor R11 and a capacitor C3. Hence cancellation of the run signal B at the respective input of the AND gate 13 is delayed by a time constant T2 by operation of the delay circuit comprising the diode D2, the capacitor C3 and the resistor R11. The ratio $t_2/t_3$ is made greater than unity in order to ensure that the monitoring system can verify that the switching transistor T1 has turned off correctly.

When activated, the opto-isolator 15 will draw current through the resistors R5 and R6 which will enable a PNP transistor T4 to produce a reset voltage signal across a resistor R12 which is used to reset a flip-flop 23. The opto-isolator 17, transistor T5 and resistors R8, R9 and R13 produce a set voltage signal for the flip-flop 23. The two complementary outputs Q and $\overline{Q}$ from the flip-flop 23 feed into two NOR gates 24 and 25 which are interconnected in such a manner as to self-check the operation of the monitoring system. The $\overline{Q}$ output of the flip-flop 23 is connected to one of the inputs of the NOR gate 24. The output of the NOR gate 25 is connected to the other input of the NOR gate 24. The output of the NOR gate 24 is connected to one input of an AND gate 26. The Q output of the flip-flop 23 is connected to one input of the NOR gate 25. The output of the AND gate 26 is connected to the other input of the NOR gate 25.

The junction 27 at which the capacitor C1 is connected into the monitor signal A path between the resistor R7 and the respective input of the AND gate 13 is connected to another input of the AND gate 26. The corresponding junction 28 between the resistor R10 and the capacitor C2 and the input of the AND gate 13 for the monitor signal B is connected to the other input of the AND gate 26.

When the flip-flop 23 is in the "set" configuration, the NOR gate 25 verifies that the output $\overline{Q}$ and the monitor output signal from the AND gate 26 are both LO and if so gives a HI signal to the AND gate 13 in the switching circuit, the output of the NOR gate 25 being connected to the third input of the AND gate 13. In the reset state of the flip-flop 23, the NOR gate 24 verifies that the output Q and the output from the NOR gate 25 are both LO and gives a HI signal to one input of the AND gate 26. When the monitor signals A and B are both HI and the output of the NOR gate 24 is HI then and only then is the monitor output signal from the AND gate 26 HI. This signal is used in conjunction with the stop/start circuit described below with reference to FIG. 2 to produce the run signals A and B.

Should the transistor T1 remain conducting when the transistor T2 switches off, the voltage $V_c$ will appear at the return side of the solenoid coil 11 and the opto-isolator 17 will be energised which will pull down the voltage at the junction Y to 0 volts and after a time delay of $t_1$ milliseconds, the monitor signal B to the AND gate 13 will disappear, effectively preventing the transistor T2 from being switched to its conducting state. Similarly if the transistor T2 remains conducting when the transistor T1 is switched off, the supply voltage $V_c$ will drive a current through the opto-isolator 15 and through the solenoid coil 11 to earth. The monitor signal A is cancelled after $t_1$ milliseconds and the transistor T1 cannot be switched on. In either case the monitor output signal goes LO. Whenever appropriate a failure warning indicator can be provided and adapted to be activated by the output signal from the AND gate 26. The absence of a HI monitor output signal from the output of the AND gate 26 when the machine is inoperative and awaiting restarting can be arranged to activate the failure warning indicator.

The resistors R14 and R15 limit current flowing through the solenoid coil 11 to a value far below that required to energise the solenoid coil 11 and effect operation of the control valve 10 but sufficient to activate the opto-isolators 15 and 17.

The monitoring system self-checks itself in the following manner when conditions are normal:

The run signals A and B arrive at the respective inputs of the respective NAND gate 12 and AND gate 13 simultaneously.

Only the NAND gate 12 has three HI input signals at this instant so that only the transistor T1 conducts. Hence the opto-isolator 17 is activated, the voltage at the junction Y drops to 0, the transistor T5 produces a set signal, and the flip-flop 23 changes state so that the output Q goes HI. The output from the NOR gate 24 goes LO and the output from the AND gate 26 goes LO. The NOR gate 25 verifies that the output from the AND gate 26 and the output $\overline{Q}$ from the flip-flop 23 are both LO and produces a HI to complete the three HI inputs to the AND gate 13 which effects switching on of the transistor T2. At this stage the opto-isolator 17 is de-energised and the voltage at the junction Y is restored to the supply voltage $V_c$. Provided all these operations occur correctly within the time $t_1$ milliseconds, the monitor signal B never disappears from the AND gate 1. If a failure occurs anywhere in this chain of events, the transistor T2 is never switched on and the machine will not start.

When the machine is to be stopped, the run signals A and B are cancelled by operation of the stop/start control circuit described below with reference to FIG. 2. Transistor T1 is turned off immediately the run signal A is cancelled. T2 continues in its conducting state for the time period $t_2$ milliseconds after cancellation of the run signal B due to the delay effect of the delay circuit comprising the diode D2, the capacitor C3 and the resistor R11 which maintains the respective input to the AND gate 13 HI for that time delay period after cancellation of the run signal B. The opto-isolator 15 is activated whilst the transistor T2 remains in its conducting state with the transistor T1 switched off. Hence the voltage at junction X is pulled down to 0 and the transistor T4 is operated to produce a reset signal which resets the flip-flop 23 so that its outputs change state. The output from the NOR gate 25 goes LO so that the respective input to the AND gate 13 goes LO and its output goes LO switching off the transistor T2. The opto-isolator 15 is de-energised so that the voltage at junction X is restored to the supply voltage $V_c$. Providing that all these operations occur correctly within $t_1$ milliseconds, the monitor signal A remains HI. If not it goes LO and the transistor T1 cannot be switched on again to restart the machine.

The NOR gate 24 verifies that the output of the NOR gate 25 and the output Q of the flip-flop 23 are both LO. If correct the NOR gate 24 gives a HI to the AND gate 26. Since the monitor signals A and B are HI also, the three inputs to the AND gate 26 are HI so that it produces a HI monitor output signal. The machine can be restarted only in this condition.

Thus every component of the switching and monitoring system is exercised and verified during each cycle of operation of the machine. Any fault developing prevents the machine from starting a subsequent cycle and therefore cannot lie dormant.

The monitor output signal from the AND gate 26 of the monitoring system is HI when both switching transistors T1 and T2 are non-conducting, and LO if either or both are conducting, or if the monitoring system has not checked out correctly.

FIG. 2 shows that the monitor output signal, which is the output from the AND gate 26 of the monitoring circuit, is fed in parallel to a respective input of each of two AND gates 27 and 28. The output of each AND gate 27, 28 is fed to the set input of a respective flip-flop 29, 31. The output signal from the Q output of the flip-flop 29 serves as the run signal A and is connected to the respective input of the NAND gate 12 of the switching circuit described above with reference to FIG. 1. The output signal from the Q output of the flip-flop 31 serves as the run signal B and is connected to the respective input of the AND gate 13 of the switch circuit shown in FIG. 1. The Q output of the flip-flop 29 is connected to one of the inputs of the AND gate 27. The Q output of the flip-flop 31 is connected to one input of a NOR gate 32. The output of the NOR gate 32 is connected in parallel to one input of an AND gate 33 and to one input of a three input NOR gate 34 which receives the run signals A and B at its other two inputs. The output of the NOR gate 34 is connected in parallel to the input of the NOR gate 32 and to an input of the AND gate 28.

The AND gate 33 receives a stop or reverse signal at its other input and its output is connected through a diode 35 in parallel to the two reset inputs of the flip-flops 29 and 31. The light screen signal is also connected through a respective diode 36 in parallel to the two reset inputs which are also connected to earth.

The two AND gates 27 and 28 are three input AND gates and the remaining input of each of them receives a respective start pulse A or B.

The logic elements in the stop/start control circuit are arranged to ensure that the run signals A and B can only be generated if the monitor output signal received from the AND gate 26 of the monitoring circuit is HI. Once initiated the run signals A and B ignore subsequent changes of state in the monitor signal and remain active until a stop or reverse motion signal is received. That is because each run signal A, B is generated by the respective flip-flop 29, 31 which remains in its set state after having been set by an appropriate output from the respective AND gate 27, 28 until it is reset by a signal which is generated independently of the state of the monitor output signal.

It should be noted that with the circuit arrangement shown in FIG. 2, the light screen has a double chance of arresting a dangerous motion in a machine fitted with the control valve 10. Not only does an interruption of the light screen switch off the transistor T1 directly, it also resets the two flip-flops 29 and 31 of the circuit shown in FIG. 2 and thereby cancels the run signals A and B. Thus both switching transistors T1 and T2 are turned off which is verified by the monitoring system. When the guard area is subsequently cleared, the motion will not recommence until two new start pulses A and B are initiated by operation of the machine start button.

Some machines employ a plurality of control valves, several of which may need to be energised simultaneously to initiate the operational cycle. In such cases a switching and monitoring system as described above with reference to FIG. 1 is used in conjunction with each control valve. For valves which are controlling motions or operations which are not intrinsically dangerous to the operator, for example a decompression of a hydraulic ram, use will be made of such a part of the complete system as is deemed necessary to satisfy the overall safety requirements for the machine.

Where there exists a plurality of control valves, there will be a plurality of monitor output signals and the machine interface logic incorporated in the stop/start control circuit will be extended to take account of all these signals.

We claim:

1. A solenoid coil switch circuit comprising two switch devices in series with the solenoid coil between a supply voltage and an earth connection, and including logic circuitry operatively associated with each switch device and operable to control switching of the respective switch device in accordance with certain parameters, the switch circuit being in combination with a monitoring circuit which is operable to monitor the state of each of the two switch devices, the monitoring circuit being operatively associated with the logic circuitry and being adapted to respond to one of the switch devices being in its conducting state when the other switch device is switched off, by changing the state of a logic signal in the logic circuitry associated with the other switch device and thereby inhibiting the other switch device from being switched to its conducting state.

2. A solenoid coil switch circuit comprising two switch devices in series with the solenoid coil between a supply voltage and an earth connection, and including logic circuitry operatively associated with each switch device and operable to control switching of the respective switch device in accordance with certain parameters, the switch circuit being in combination with a monitoring circuit which is operable to monitor the state of each of the two switch devices, the monitoring circuit being operatively associated with the logic circuitry and being adapted to respond to one of the switch devices being in its conducting state when the other switch device is switched off, by changing the state of a logic signal in the logic circuitry associated with the other switch device and thereby inhibiting the other switch device from being switched to its conducting state, and wherein the monitoring circuit comprises two circuit paths which are connected in parallel into the switch circuit each at a respective one of two junctions between the two switch devices, the solenoid coil being between the two junctions, each signal path including signal emitter means operable to emit an output signal when energized and differential resistance means between each said signal emitter means and the switch circuit, said differential resistance means being operable to inhibit current flow in the respective circuit path sufficient to energize said signal emitter means when subjected to an electrical potential difference which is less than a predetermined amount and to allow sufficient current flow in that circuit path to energize the respective signal emitter means when subjected to a potential difference which is at least said predetermined amount, the signal emitter means of one of the circuit paths being connected between the supply voltage and the switch circuit while the signal emitter means of the other circuit path is connected between the switch circuit and an earth connection, each said signal emitter means being operatively associated with respective signal receiver means, the signal receiver means associated with the signal emitter means of said one circuit path being operatively associated with the logic circuitry operatively associated with the switch device that is the nearer one of the two switch devices to the supply voltage connection of the switch circuit and the signal receiver means associated with the signal emitter means of said other circuit path being operatively associated with the logic circuitry operatively associated with the other switch device, each said signal receiver means being operable in response to a received signal emitted by the associated signal emitter means to change the state of a logic signal in the associated logic circuitry and thereby inhibit the associated switch device from being switched to its conducting state, the resistance of each circuit path being sufficient to ensure that the solenoid coil is not energized by current flow in that path, and the differential resistance means of the two circuit paths together inhibiting current flow through them in series sufficient to energize said signal emitter means.

3. A combination according to claim 2, wherein each said signal emitter means comprises a light emitting diode and each said signal receiver means comprises a photo transistor which is connected between a junction in the associated logic circuitry and an earth connection.

4. A combination according to claim 3, wherein each said signal emitter means and associated signal receiver means together comprise an opto-isolator.

5. A combination according to claim 2, wherein each logic circuitry includes delay means operative to delay the change of state of the respective logic signal for a predetermined time interval, and self-check logic circuitry operatively associated with said monitoring circuit is provided, said self-check logic circuitry being operable automatically to verify the state of all components of said monitoring circuit which change state when operated, and to emit an output which inhibits switching of one of the switch devices to its conducting state until it, said output, changes state when the state of all those components has been verified, the delay effected by said delay means enabling said one switch device to be switched to its conducting state before that is inhibited by a change of state of said logic signal.

6. A combination according to claim 5, wherein said self-check logic circuitry includes flip-flop means having complementary outputs, means responsive to operation of each sid signal receiver means whereby to set said flip-flop means in response to operation of one of said signal receiver means and to reset said flip-flop means in response to operation of the other signal receiver means, and logic means responsive to the complementary outputs of the flip-flop means and operable to generate said output of the self-check logic circuitry.

7. A combination according to claim 6, including further logic means responsive to the logic signals in the logic circuitry associated with the two switch devices and to another output from said logic means response to the complementary outputs of said flip-flop means, said further logic means being operative to emit a monitor output signal which is in one state when the two switch devices are switched of and all said components of the monitoring circuit have been verified, and which is otherwise in another state, the logic means responsive to the complementary outputs of the flip-flop means being also responsive to said monitor output signal.

8. A combination according to claim 7, further including logic control means responsive to said monitor output signal and operable to generate two control signals independently when said monitor output signal is in said one state, each said control signal being fed to the logic circuitry operatively associated with a respective one of the switch devices to effect switching of that switch device to its conducting state, said logic control means being operable to continue generating said control signals regardless of subsequent changes of state of said monitor control signal.

9. A combination according to claim 8, wherein said logic control means includes two flip-flop devices, the output signal from one of the outputs of each flip-flop device serving as a respective one of the control signals.

10. A combination according to claim 8, wherein the logic circuitry operatively associated with one of the switch devices includes further delay means operative to delay cancellation of the respective one of the two control signals for a second predetermined time period after the logic control means operated to discontinue that signal, the second predetermined period being greater than the first mentioned predetermined time interval.

11. A combination according to claim 1 wherein each switch device is a solid state switch device.

12. A combination according to claim 2, wherein each switch device is a solid state switch.

13. A solenoid coil switch circuit comprising two solid state switch devices in series with the solenoid between a supply voltage and an earth connection, and including logic circuitry operatively associated with each solid state switch device and operable to control switching of the respective switch device in accordance with certain parameters, the switch circuit being in combination with a monitoring circuit which is operable to monitor the state of each of the two solid state switch devices, the monitoring circuit being operatively associated with the logic circuitry and being adapted to respond to one of the solid state switch devices being in its conducting state when the other solid state switch device is switched off, by changing the state of a logic signal in the logic circuitry associated with the other solid state switch device and thereby inhibiting the other solid state switch device from being switched to its conducting state.

* * * * *